US005875935A

United States Patent [19]

Koch et al.

[11] Patent Number: 5,875,935

[45] Date of Patent: Mar. 2, 1999

[54] APPARATUS FOR ASSISTING THE DISCHARGE OF SLOW-FLOWING BULK GOODS FROM CONTAINERS

[75] Inventors: Martin Koch, Neuenburg/Baden; Günter Untch, Müllheim/Baden, both of Germany

[73] Assignee: GEI GmbH, Mullheim, Germany

[21] Appl. No.: 948,054

[22] Filed: Oct. 9, 1997

[30] Foreign Application Priority Data

Oct. 10, 1996 [DE] Germany ..... 196 41 827.5

[51] Int. Cl.[6] ..... A45D 24/22

[52] U.S. Cl. ..... 222/200; 222/556

[58] Field of Search ..... 222/198, 200, 222/556

[56] References Cited

U.S. PATENT DOCUMENTS 5,540,266 7/1996 Grau et al. .

FOREIGN PATENT DOCUMENTS 195 34 915 11/1996 Germany .

*Primary Examiner*—Gregory L. Huson

*Attorney, Agent, or Firm*—Burns, Doane, Swecker & Mathis, L.L.P.

[57] ABSTRACT

In order to promote a gravity flow of bulk goods through a discharge opening of a container, a vibratable body is arranged to project into the container through the discharge opening and is vibrated. The vibratable body is sandwiched between a tubular flexible piece and a tubular connecting flange which together define a passage aligned with the discharge opening. A vibrator vibrates the connecting flange, and the vibrations are transmitted therefrom to the vibratable body. Vibration of the vibratable body is permitted by the flexibility of the flexible piece.

9 Claims, 1 Drawing Sheet

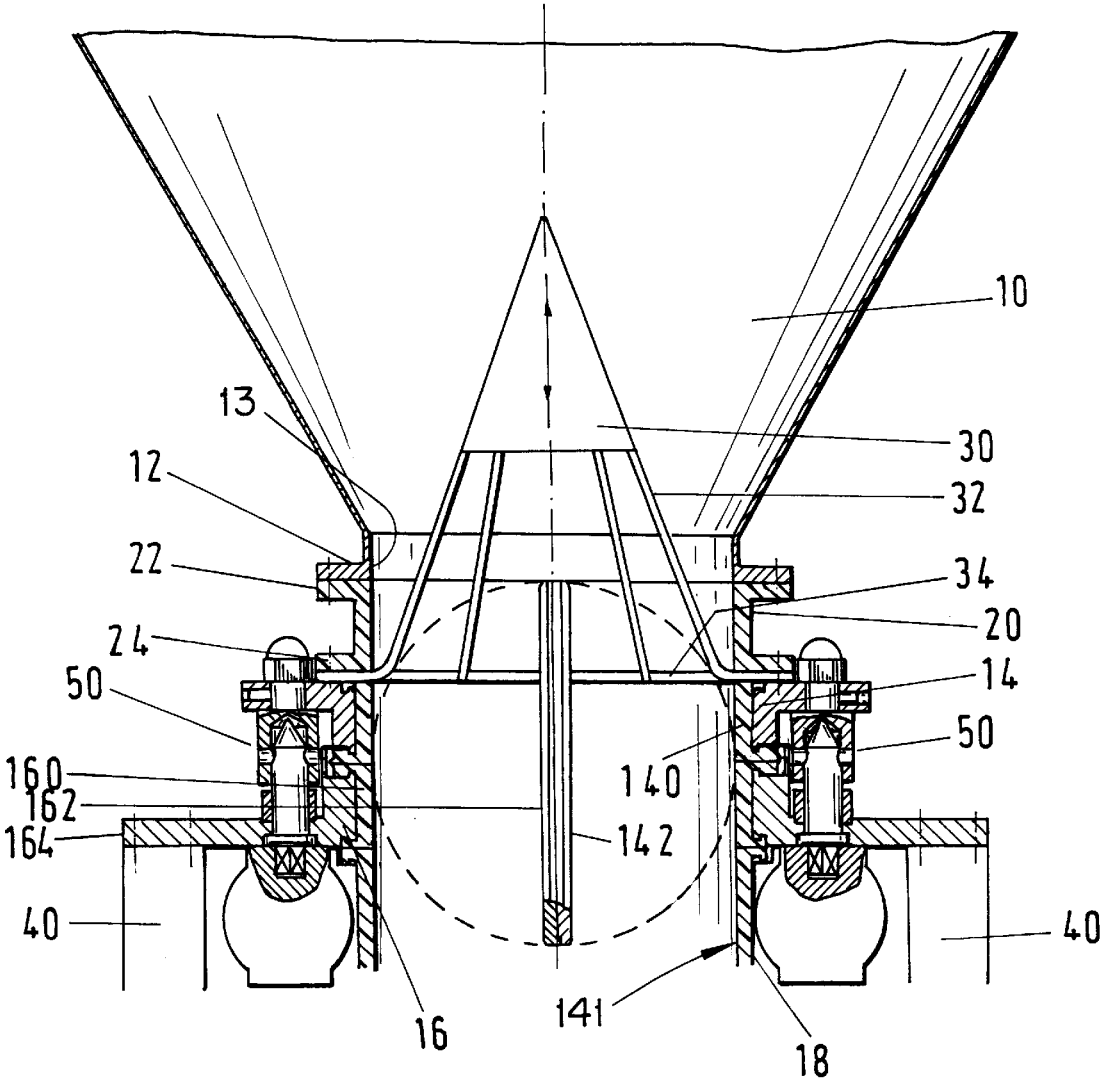
10
13
30
12
32
22
34
20
24
14
50
50
160
140
162
164
142
40
40
16
141
18

APPARATUS FOR ASSISTING THE DISCHARGE OF SLOW-FLOWING BULK GOODS FROM CONTAINERS

BACKGROUND OF THE INVENTION

The invention pertains to an apparatus for facilitating the delivery of slow-flowing bulk goods which are to be unloaded from a container that is directly or indirectly coupled to a connecting flange.

When slow-flowing bulk goods are allowed to flow from receptacles with comparatively small openings, such as those formed by connecting socket pieces, the problem of bridging often arises in the bulk goods, a problem which makes it practically impossible to unload the bulk goods. This problem can be avoided by keeping the bulk goods in the container constantly flowing. Until now, assistance in this regard has been provided by placing the container itself into oscillation by means of a vibrator applied to it, or by putting the container stand on elastic feet and placing the stand into oscillation by means of an unbalance motor. This procedure is not satisfactory because it places an extraordinarily high stress on the container or stand and can possibly even lead to a further compaction of the bulk material.

In accordance with a different principle, a cone which also serves as the stopper for the connecting socket piece is placed into the container and is moved up and down mechanically. Before the mechanical movement can be initiated in this case, the discharge passage must be opened.

It is the task of the invention to make available a device to assist the delivery of slow-flowing bulk goods which can be operated even with a closed discharge passage.

SUMMARY OF THE INVENTION

In accordance with the invention, provision is made that a flexible intermediate piece is provided between the container and the connecting flange, and that a vibrating body is provided which projects into the container and which can be moved with the connecting flange. The vibrating body can in principle be of any desired shape.

It is useful for the vibrating body to be joined with a coupling ring that is to be coupled to the connecting flange.

In order to achieve the common movement of the connecting flange and the vibrating body, it is preferable that at least one vibrator be provided that makes direct or indirect contact with the connecting flange.

A form of implementation that is especially preferred is characterized by the fact that the connecting flange is part of a connecting socket piece with an essentially circular cross section in a device for the coupling of two containers. Each container exhibits a connecting socket piece, in conjunction with which each of the connecting socket pieces exhibits, near its end which faces away from the respective container, a closing flap which has an essential circular cross section, an outside diameter which essentially corresponds to the inside diameter of the socket piece, and can be pivoted by in essence 90° around a diameter of the socket piece. The flap can be moved from a closed position in which it stands essentially transverse to the longitudinal center axis of the socket piece in question, into an open position in which it is in essence parallel to the longitudinal center axis of the socket piece in question by means of a pivoting drive which contacts only one of the closing flaps. The correcting socket piece in which the driven closing flap is mounted can be contacted by the vibrator, of which there is at least one, whereby a floating mounting of this connecting piece transfers to the connecting socket pieces an oscillating movement introduced by the vibrator. The oscillating movement of the connecting socket pieces is made possible by means of a floating mounting of the connecting socket piece which does not lie against the intermediate piece.

One conceivable form of implementation for the vibrating body consists in the fact that it is configured as a cone, the point of which, as viewed from the collecting flange, projects into the container. This cone is connected to a coupling ring which is to be coupled to the connecting flange.

With the invention, it is possible to bring kinetic energy into the system in a surprisingly simple way, without having to open the system. The oscillations of the vibrating body which projects into the container destroy any bridge formations of the bulk goods which might occur, or even prevent them. The invention is given an especially elegant application in connection with coupling devices which work according to the closing flap principle, which is described, for example in German Document 43 42 962. Specifically, in that case a vibration which is created in the active flap can be introduced into the container.

BRIEF DESCRIPTION OF THE DRAWING

In the following, the invention is to be described in more detail with the aid of the attached drawing. The sole Figure shows a sectional view through the longitudinal center axis of a container with connecting socket pieces.

DETAILED DESCRIPTION OF THE PREFERRED EMBODIMENT OF THE INVENTION

A partially shown container 10, of which in essence only the discharge portion is shown, has in this region walls which are configured in a funnel shape and which are formed into a ring flange 12 at a discharge opening 13. Fastened to this ring flange 12 is a hollow cylindrical intermediate piece in the form of a collar 20 which is made of a flexible or pliant material, for example, from an elastomer such as silicone. In conjunction with that, the collar 20 is retained at its end facing the ring flange 12 by means of a ring flange 22 bolted thereto. A similar ring flange 24 is provided at the opposite end of the collar 20.

A device for the coupling of two containers comprises a first hollow cylindrical connecting piece in the form of a connecting flange 14 and a second hollow cylindrical connecting piece 16. Both of the two pieces 14, 16 support, on their inner walls, respective portions 140, 160 of a seal 141. Inner surfaces of the collar 20 and seal 141 are aligned and form a cylindrical passage. Mounted in each the passage is a closing flap 143 comprised of two disks 142, 164 described in more detail in German Document 43 42 692. One of the disks, e.g., a disk which is known as the active disk, can be connected to a rotary drive (not shown in the drawing), and which carries with it during a pivoting movement the other disk 142, known as the passive disk. In order to guide the two connecting pieces 14, 16 into the best possible position, centering devices 50 are provided. An especially preferable configuration of a centering device winch also provides for automatic latching of the closing flaps in the docked state is described in related German Patent Application No. 195 34 915.6, the disclosure of which is incorporated herein by reference. A floating mounting 18 is placed at the piece 16.

A vibratable body 30 is mechanically coupled between the collar 20 (or more specifically, between the ring flange 24) and the connecting piece 14. This vibratable body 30 is connected by means of stanchions 32 to a coupling ring 34 that is held between the ring flange 24 and the seal portion 140 in such a way that an oscillation applied either directly or indirectly to the connecting piece 14 is transferred to the coupling ring 34 and thus to the vibratable body 30.

The application of the oscillation energy is carried out by means of vibrators 40 which are coupled to coupling flanges 164 which form a part of the connecting piece 16. As a result of the mechanical coupling of the connecting pieces 14 and 16, the oscillation energy given off by the vibrators 40 is first transferred to the connecting socket piece 16, then to the connecting socket piece 14, on to the coupling ring 34, and thus to the vibrating body 30, which is moved, for example, in the directions indicated by the double arrow, depending on the intensity of the oscillation by the vibrators 40. In conjunction with this, the flexible collar 20 allows relative movement between the vibrating body 30 and the container 10.

The oscillations of the vibrating body which projects into the container destroy any bridge formations of the bulk good which might occur, or even prevent them. Advantageously, this is achieved without having to open the discharge passage.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed:

1. Apparatus for conducting flowable bulk goods from a container, the apparatus comprising:

a container for containing flowable bulk goods, the container having a discharge opening;

a hollow connecting flange disposed below the discharge opening;

a hollow flexible piece disposed between the connecting flange and the container;

a vibratable body projecting into the container through the discharge opening and being operably connected to the connecting flange for movement therewith; and a vibrator operably connected to the connecting flange for vibrating the connecting flange and vibratable body to promote a flow of the bulk goods.

2. The apparatus according to claim 1 wherein the vibratable body is mounted between the connecting flange and the flexible piece whereby vibration of the vibratable piece is permitted by the flexibility of the flexible piece.

3. The apparatus according to claim 1 wherein the vibratable body includes a mounting ring disposed between the flexible piece and the connecting flange.

4. The apparatus according to claim 1, further comprising a connecting piece disposed below the connecting flange for forming a passage therewith, the passage aligned with the discharge opening; a closure flap rotatably disposed in the passage below the vibratable body for opening and closing the passage; the vibrator connected to the connecting piece.

5. The apparatus according to claim 4 wherein the closure flap comprises two disks, one of the disks being driven.

6. The apparatus according to claim 1 wherein the vibratable body is of generally conical shape, an apex of the conical shape projecting toward the container.

7. The apparatus according to claim 1, further comprising a closure valve for selectively blocking and permitting flow from the discharge opening, the vibratable body being vibratable with the valve closed.

8. An apparatus comprising:

a container for containing flowable bulk goods, the container having a downwardly open discharge opening;

a hollow connecting flange disposed below the discharge opening and forming an inner wall lined by a sealing material;

a hollow flexible piece disposed between the connecting flange and the container, the flexible piece and sealing material forming a passage aligned with the discharge opening;

a valve mounted in the passage for opening and closing the passage;

a vibratable body projecting into the container through the discharge opening, a portion of the vibratable body disposed between the flexible piece and the sealing material; and a vibrator operably connected to the connecting flange for vibrating the connecting flange to promote a flow of the bulk goods through the discharge opening, the vibrations being transmitted from the connecting flange to the vibrating body, with vibration of the vibratable body being permitted by the flexibility of the flexible piece.

9. The apparatus according to claim 8 wherein the vibratable body is vibratable with the valve closed.

* * * * *